16?-51 SR
10/22/85 OR 4,548,274

United States Patent [19]
Simpson

[11] Patent Number: 4,548,274
[45] Date of Patent: Oct. 22, 1985

[54] AUTOMATICALLY OPENING DECORATIVE FIRE EXTINGUISHER COVER

[76] Inventor: Timothy J. Simpson, 625 Meadowview Dr., Greenwood, Ind. 46142

[21] Appl. No.: 548,958

[22] Filed: Nov. 7, 1983

[51] Int. Cl.[4] ..... A62C 25/00
[52] U.S. Cl. ..... 169/51; 169/61; 292/144; 292/171
[58] Field of Search ..... 169/51, 60, 61; 292/DIG. 11, 144, 171

[56] References Cited

U.S. PATENT DOCUMENTS

| | | | |
|---|---|---|---|
| D. 250,377 | 11/1978 | Dooley et al. | 169/51 X |
| 1,191,347 | 7/1916 | Rupert | 292/144 |
| 2,499,727 | 3/1950 | Craig | 292/144 X |
| 4,015,250 | 3/1977 | Fudge | 169/51 X |
| 4,018,242 | 4/1977 | Schlegel . | |
| 4,034,697 | 7/1977 | Russel | 169/51 X |
| 4,062,493 | 12/1977 | Suggs . | |
| 4,223,739 | 9/1980 | Waters . | |
| 4,244,426 | 1/1981 | Kerr | 169/51 |
| 4,276,939 | 7/1981 | Atack | 169/60 |

FOREIGN PATENT DOCUMENTS

| | | | |
|---|---|---|---|
| 2447205 | 9/1980 | France | 169/51 |

*Primary Examiner*—Andres Kashnikow
*Assistant Examiner*—Daniel R. Edelbrock
*Attorney, Agent, or Firm*—Woodard, Weikart, Emhardt & Naughton

[57] ABSTRACT

A decorative housing for a fire extinguisher. A five sided box forms a cavity to receive and hold a fire extinguisher. A door or decorative cover is slidably mounted to the box adjacent the cavity and is movable from an up position closing the cavity and concealing the fire extinguisher to a down position revealing the fire extinguisher. A heat and smoke detector mounted to a clock frame above the box is connected to a source of electrical energy and in turn to a solenoid. The plunger of the solenoid normally extends into the door locking the door in the closed position. Activation of the detector withdraws the plunger allowing the door to slide downwardly. An audio alarm and light within the box cavity activate simultaneously upon the withdrawal of the plunger. A cord is connected to the plunger to allow manual withdrawal of the plunger and opening of the door.

4 Claims, 3 Drawing Figures

AUTOMATICALLY OPENING DECORATIVE FIRE EXTINGUISHER COVER

BACKGROUND OF THE INVENTION

This invention is in the field of covers or housings for fire extinguishers and more specifically those having a door to allow access to the fire extinguisher. The fire extinguisher should be located in the area or room where the extinguisher is needed; however, many people will not hang a red fire extinguisher on the living room wall or den wall etc. because of the gaudy appearance. People in general will place the fire extinguisher in a drawer or closet, out of sight and then forget the location. When a fire occurs, the fire extinguisher is not available instantly and the location may be completely forgotten in the moment of excitement.

The housing disclosed herein provides for the instant availability of the fire extinguisher in the area or room where the extinguisher is needed and also adds to the decor of the room. The housing automatically senses smoke/heat, sounds an alert, and opens its door illuminating the fire extinguisher mounted therein for instant usage in the area of the fire.

My decorative fire extinguisher cover is the subject of disclosure document number No. 118802 filed with the United States Patent and Trademark Office on July 18, 1983.

A number of United States patents have been granted disclosing the general idea of a housing for a fire extinguisher. A typical housing including a glass door is shown in U.S. Pat. No. 4,015,250, issued to Fudge on Mar. 29, 1977 which also includes a security alarm alerting the owner whenever the door is opened. Another type of housing is disclosed in U.S. Pat. No. 4,244,426, issued to Kerr on Jan. 13, 1981 wherein a fire extinguisher along with fire hose is mounted within a wall hung box having a front door with a decorative cover provided thereon. An advantage of my housing as compared to the prior decorative housing is the automatic opening of the decorative cover upon the detection of a fire with simultaneous illumination of the extinguisher coupled with an audio alarm allowing for the instant recognition of the need and location of the fire extinguisher. Other types of housings have been developed which contain a fire hose such as disclosed in U.S. Pat. Nos. 4,062,493, issued to Suggs on Dec. 13, 1977 and 4,018,242, issued to Schlegel on Apr. 19, 1977. Another approach is disclosed in U.S. Pat. No. 4,223,739, issued to Waters on Sept. 23, 1980 which discloses a portable decorative housing containing a fire extinguisher operated while remaining within the housing.

SUMMARY OF THE INVENTION

One embodiment of the present invention is an automatically opening decorative enclosure for holding a fire extinguisher comprising a housing mountable to a wall and having a cavity with a vertical opening sized to receive and hold a fire extinguisher, a door slidably mounted to the housing adjacent the vertical opening and movable by the force of gravity from an up position closing the cavity to a down position opening the cavity and revealing the fire extinguisher, detection means operable to detect fire and to then produce a signal, and holding means on the housing operable to hold the door in the up position to release same upon receipt of the signal allowing the door to fall to the down position.

Another embodiment of the present invention is a combination clock and fire extinguisher apparatus comprising a housing mountable to a wall and having a cavity with a vertical opening sized to receive and hold a fire extinguisher, a fire extinguisher positioned within the cavity but removable therefrom, a door slidably mounted to the housing adjacent the vertical opening and movable by the force of gravity from an up position closing the cavity to a down position opening the cavity and revealing the fire extinguisher, detection means operable to detect fire and to then produce a signal, holding means on the housing operable to hold the door in the up position and to release same upon receipt of the signal allowing the door to fall to the down position, a housing extension cantileveredly mounted to the housing and extending thereabove being spaced apart from the wall forming a recess therebetween and including a clock mounted to the extension, a pull ring and cord positioned within the recess and supported by the housing extension with the cord extending into the cavity and connected to the holding means to allow manual activation of same allowing the door to fall to the down position.

It is an object of the present invention to provide a decorative fire extinguisher cover which will automatically open upon a detection of smoke or heat.

A further object of the present invention is to provide an automatically opening decorative enclosure for holding a fire extinguisher including illumination means and audio alarm means pinpointing the location of the extinguisher.

In addition, it is an object of the present invention to provide a new and improved fire extinguisher housing.

In addition, it is an object of the present invention to provide a fire extinguisher decorative cover which may be manually or automatically opened.

Related objects and advantages of the present invention will become apparent from the following description.

DESCRIPTION OF THE PREFERRED EMBODIMENT

Figure 1:
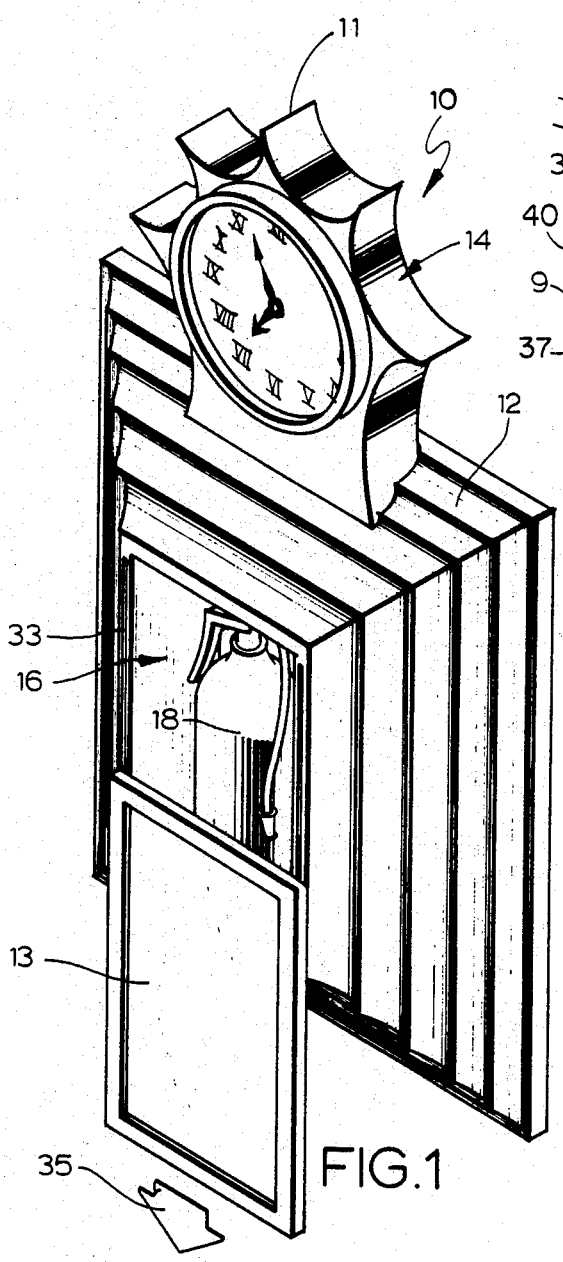
FIG. 1 is a perspective view of the decorative fire extinguisher housing shown in the open position.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to the drawings, there is shown the automatically opening decorative housing 10 incorporating the present invention mounted to wall 9. Housing 10 includes a five sided box construction 12 forming a cavity 16 therein for removably holding a conventional fire extinguisher 18. The outwardly facing side of box construction 12 forms a vertical opening leading into cavity 16 with a decorative cover or door 13 slidably mounted to the housing construction adjacent to the vertical opening. Door 13 is movable in the direction of arrow 35 from an up position wherein the cavity and fire extinguisher are completely concealed to a downward position opening the cavity and revealing the fire extinguisher.

A detection means is provided to detect a fire and to then produce an electrical signal. The detection means includes a sensor 36 mounted to the top 11 of clock 14 in turn cantileveredly mounted to and extending upwardly from housing construction 12. Clock 14 is spaced apart from wall 9 forming recess 37 allowing the wiring 23 to extend from sensor 36 downwardly into cavity 16 to circuit box 20. Mounted within the cavity or within box 20 is a source of electrical energy such as a plurality of batteries. The source of electrical energy in turn is connected to an audio alarm 24, solenoid 26, light 17 and reset button 22. The circuitry 21 within box 20 is conventional in nature and is commercially available from such as found in the many smoke detectors or heat detectors on the market. For example, the batteries may be connected in series with the sensor 36, alarm 24, solenoid 26, and light 17. In most available systems, depression of button 22 results in the source of electrical energy being cut to circuitry within box 20. Upon detection of heat or smoke by sensor 36, the sensor will close applying the electrical energy across the alarm, solenoid and light. Sensor 36 is operable to detect fire through the detection of either heat or smoke and to produce an electrical signal such as by connecting the source of electrical energy to the alarm and light while also connecting the solenoid across the source of electrical energy thereby allowing door 13 to fall by the force of gravity from the closed or up position to the downward or open position.

Construction 12 has a pair of vertically extending recesses 33 positioned on the opposite sides of cavity 16 immediately adjacent door 13. Likewise, the door includes a pair of inwardly extending projections 38 positioned on the opposite sides of cavity 16 and aligned with and extending into recesses 33. Projections 38 and recesses 33 guide the cover as it falls in the direction of arrow 35 and as it is moved upwardly in the direction of arrow 34 to the closed position. The downwardly facing surface 39 of each projection 38 forms a stop surface which in turn contacts the bottom upwardly facing edge of recess 33 when the cover is in the downward position thereby limiting further movement of the cover and preventing the cover from disengagement with the housing construction. A recess is provided in the outwardly facing surface of cover 13 to facilitate the installation of a picture, painting or mirror to enhance the decorative nature of the housing.

A door latch cavity 27 is formed in the upper portion of cover 13 and opens inwardly towards the bevel shaped end 29 of the plunger of solenoid 26. Thus, as the cover is closed or moved upwardly in the direction of arrow 34, the top edge of the cover will engage the bevel surface of the plunger temporarily depressing the plunger until it is allowed to move outwardly into recess 27 locking the door in the closed position until the plunger is automatically or manually withdrawn. The circuitry 21 provides for the automatic withdrawal of the plunger whereas pull ring 32 and cord 30 allow for the manual withdrawal of the plunger. Cord 30 is attached to the inner end 31 of the solenoid plunger with the cord then extending rearwardly partially around a pulley wheel and then upwardly into recess 37 wherein the top end of the cord is attached to pull ring 32 positioned within the recess. In order to manually open the door, a person may simply grasp pull ring 32 and pull upwardly thereby withdrawing the plunger. A spacer 40 mounted to the back of clock 14 is provided with a hole through which the cord extends thereby positioning at all times the pull ring in the upward confines of the recess. A hole extending into the cavity is positioned adjacent the pulley wheel to guide the cord downwardly around the pulley wheel and into the solenoid.

The operation of the decorative fire extinguisher housing is completely automatic once connected to the source of electrical energy. Upon detection of a fire through the use of conventional detecting means for detecting smoke or heat, the source of electrical energy is connected to the solenoid retracting the plunger and allowing the door or cover to fall downwardly. Simultaneously, the source of electrical energy is connected to light 17 and alarm 24 resulting in the illumination of cavity 16 accompanied by an audio alarm. A person in the vicinity will therefore be attracted by the light and sound to the fire extinguisher. Alternately, the pull ring may be pulled upwardly causing the plunger to be retracted.

Figure 2:
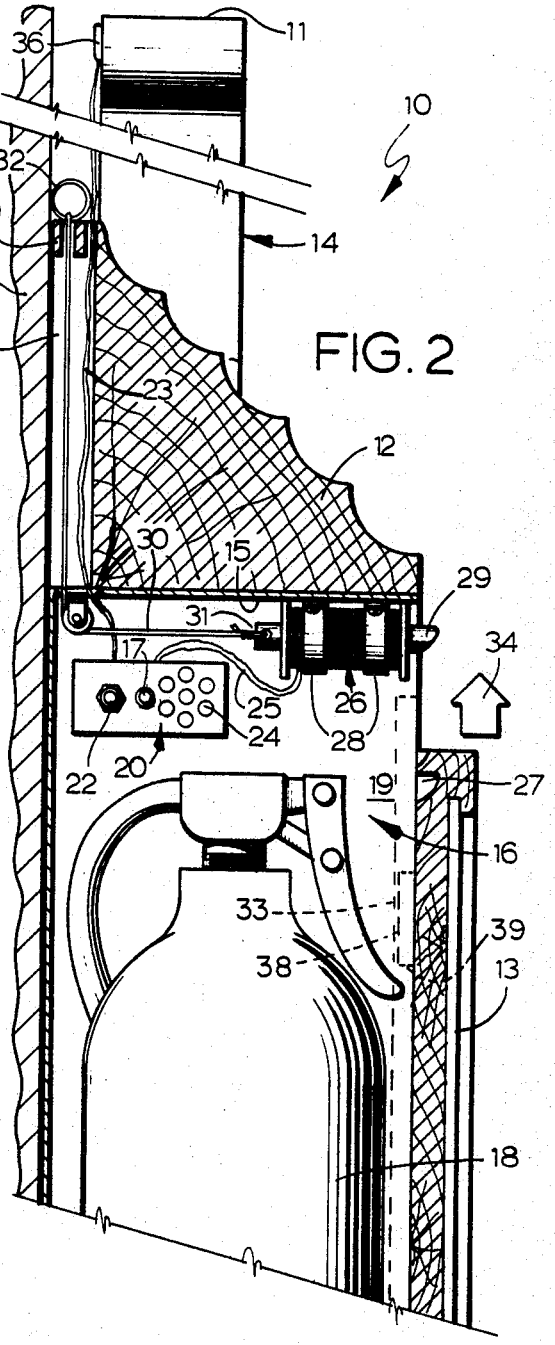
FIG. 2 is an enlarged fragmentary cross-sectional view of the housing of FIG. 1 showing the door on the decorative cover moving to the closed position.
Figure 3:
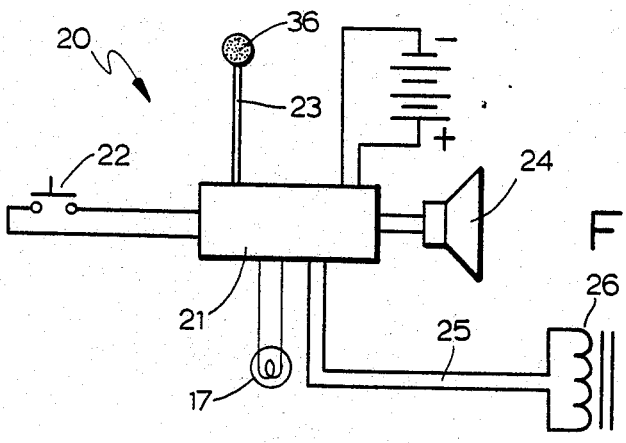
FIG. 3 is an electrical schematic diagram of the circuitry incorporated in the housing of FIGS. 1 and 2.

The circuit box 20 and solenoid 26 may be mounted by a variety of means within the box construction. In FIG. 2, the solenoid is mounted by bands 28 to the upper wall 15 whereas box 20 is mounted to wall 19. It will be noted that solenoid 26 is positioned at the highest possible location within the cavity to prevent engagement of the fire extinguisher with the solenoid upon removal of the fire extinguisher from the cavity. Suitable wiring 23 and 25 is provided to respectively connected the sensor 36 and solenoid 26 to circuit box 20.

It will be obvious from the above description that the present invention provides a new and improved decorative cover for a fire extinguisher. It will be further obvious from the above description that the present invention includes an automatically opening decorative housing for holding a fire extinguisher including detecting means operable to detect a fire and to activate circuit means for opening the housing door, sounding an alarm and illuminating a fire extinguisher positioned therein.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed in:

1. A combination clock and fire extinguisher apparatus comprising:

a housing mountable to a wall and having a cavity with a vertical opening sized to receive and hold a fire extinguisher;

a fire extinguisher positioned within said cavity but removable therefrom;

a door slidably mounted to said housing adjacent said vertical opening and movable by the force of gravity from an up position closing said cavity to a down position opening said cavity and revealing said fire extinguisher;

detection means operable to detect fire and to then produce a signal;

holding means on said housing operable to hold said door in said up position and to release same upon receipt of said signal allowing said door to fall to said down position;

a housing extension cantileveredly mounted to said housing and extending thereabove being spaced apart from said wall forming a recess therebetween;

a clock mounted to said extension;

a spacer mounted to said extension and extending rearwardly through said recess against said wall, said spacer having a vertical hole extending therethrough;

a pull ring and cord connected to said holding means to allow manual activation of same allowing said door to fall to said down position, said cord extending through said hole of said spacer and then through said recess and into said cavity to said holding means, said pole ring resting atop said spacer and concealed with said cord by said housing extension.

2. The apparatus of claim 1 wherein:

said door has a plunger hole and said holding means has a solenoid electrically connected to said detection means which includes a retractable plunger extending lockingly into said plunger hole of said door when in said up position, said plunger being retractable by said solenoid automatically upon said detection means detecting a fire, said plunger having an inner end connected to said cord allowing for the retraction of said plunger when said pull ring is pulled upwardly, said plunger further having an outer end with a downwardly facing beveled surface contacting said door as said door is moved to the up position depressing said plunger until said outer end is aligned with said plunger hole, said housing includes a five sided box forming said cavity with said solenoid positioned at the highest position possible within said cavity.

3. The apparatus of claim 2 wherein:

said housing has vertically extending channels and said door has ridges extending into said channels guiding said door as the door moves from an up position to a down position, said channels and ridges include stop surfaces to limit travel of said door.

4. The enclosure of claim 3 wherein said housing includes an opening extending into said cavity and a pulley wheel mounted within said cavity adjacent said opening, said cord extends through said opening partially around said wheel to said plunger, said door includes an outwardly opening recess and a mirror mounted within said recess.

* * * * *